US010934050B2

(12) United States Patent
Lagace et al.

(10) Patent No.: US 10,934,050 B2
(45) Date of Patent: Mar. 2, 2021

(54) STORAGE CUP FOR USE WITH COMPOSITE CONTAINER

(71) Applicant: Sonoco Development, Inc., Hartsville, SC (US)

(72) Inventors: Chad E Lagace, Cohoes, NY (US); Keith E Antal, Nebo, NC (US)

(73) Assignee: Sonoco Development, Inc., Hartsville, SC (US)

( * ) Notice: Subject to any disclaimer, the term of this patent is extended or adjusted under 35 U.S.C. 154(b) by 697 days.

(21) Appl. No.: 15/141,900

(22) Filed: Apr. 29, 2016

(65) Prior Publication Data

US 2017/0008658 A1 Jan. 12, 2017

Related U.S. Application Data

(60) Provisional application No. 62/189,568, filed on Jul. 7, 2015.

(51) Int. Cl.

| | |
|---|---|
| ***B65D 3/24*** | (2006.01) |
| ***B65D 81/32*** | (2006.01) |
| ***B65D 3/04*** | (2006.01) |
| ***B65D 3/12*** | (2006.01) |
| ***B65D 8/00*** | (2006.01) |

(52) U.S. Cl.

CPC ..... *B65D 3/24* (2013.01); *B65D 81/3216* (2013.01); *B65D 3/04* (2013.01); *B65D 3/12* (2013.01); *B65D 15/06* (2013.01)

(58) Field of Classification Search

CPC ..... B65D 3/24; B65D 81/3216

USPC ..... 426/119, 128; 206/830; 220/609

See application file for complete search history.

(56) References Cited

U.S. PATENT DOCUMENTS

| | | | | |
|---|---|---|---|---|
| 2,663,450 | A | 11/1951 | Bourcart | |
| 2,752,251 | A * | 6/1956 | Peters | B65D 85/72 426/124 |
| 2,949,369 | A | 10/1956 | Zoeller et al. | |
| 3,070,275 | A * | 12/1962 | Bostrom | B65D 51/28 229/4.5 |
| 3,182,890 | A | 5/1965 | Elam | |
| 3,851,757 | A | 12/1974 | Turprin | |
| 4,627,986 | A | 12/1986 | Bardsley et al. | |
| 5,852,901 | A | 12/1998 | Meyers | |
| 5,857,613 | A | 1/1999 | Drummond et al. | |
| 5,950,913 | A | 9/1999 | Rea et al. | |
| 6,109,470 | A | 8/2000 | Antal, Sr. et al. | |
| 6,116,500 | A * | 9/2000 | Cahill | B65D 3/18 206/216 |

(Continued)

*Primary Examiner* — Erik Kashnikow
*Assistant Examiner* — Lela S. Williams
(74) *Attorney, Agent, or Firm* — Flaster/Greenberg PC

(57) ABSTRACT

A package is defined to retain a first product and a separate ingredient. The package includes a hollow tubular body and first and second end closures sealed to the ends of the tube. A retainer cup is provided for storing the separate ingredient. The retainer cup includes a generally tubular cup wall, with an upper edge portion defining a support rim that surrounds a cup opening. One sidewall of the cup wall includes a plurality of concave curved groves forming a scalloped surface. The scalloped surface extends longitudinally along the cup wall and defines a scalloped edge profile for the support rim. A closure lid overlies the cup opening and closes the separate ingredient within the cup interior.

17 Claims, 8 Drawing Sheets

(56) References Cited

U.S. PATENT DOCUMENTS

| | | | | |
|---|---|---|---|---|
| 6,257,438 | B1 * | 7/2001 | von Holdt, Jr. ..... | B65D 1/12<br>220/656 |
| 6,422,455 | B1 | 7/2002 | Cahill et al. | |
| 7,757,935 | B2 | 7/2010 | Clougherty | |
| 2009/0123677 | A1 | 5/2009 | Sins | |
| 2009/0134168 | A1 * | 5/2009 | Morrissette ..... | B65D 81/3294<br>220/501 |

* cited by examiner

STORAGE CUP FOR USE WITH COMPOSITE CONTAINER

CROSS REFERENCE TO RELATED APPLICATION

The present application claims priority to and the benefit of the filing date of U.S. Provisional Application Ser. No. 62/189,568, filed Jul. 7, 2015.

FIELD OF THE INVENTION

The present disclosure relates to a storage cup for use within a tubular package of the type that typically retains an expandable product, such as refrigerated dough, with the cup retaining a separate product ingredient.

BACKGROUND OF THE INVENTION

Certain packages for refrigerated dough products are formed as a hollow tube by spirally wound composite materials with metal ends caps. These packages retain the dough, or similar product, and are refrigerated while being shipped and stored prior to use. It is sometimes desirable to separate certain ingredients, such as condiments, topping, spices, and the like, from the retained dough or other product within the package. When the consumer opens the package to remove the dough for baking or the like, they will also have access to the separate ingredient. It is a common practice to package the separate ingredient in a pouch or wrapper and place the pouch within one or more storage cups positioned at one end of the package. Alternatively, the separate ingredient may be retained within the cup without a separate wrapper. A disk shaped lid may be provided to cover the open end of the cup to separate the dough or the like from the ingredient retained within the cup. The disk is sometimes formed by a coated metal material.

Examples of storage cups positioned within tubular refrigerated dough packages are shown by U.S. Pat. No. 3,182,890 to Elam, U.S. Pat. No. 5,950,913 to Rea et al. and U.S. Pat. No. 6,109,470 to Antal, Sr. et al.

SUMMARY OF THE INVENTION

The present disclosure relates to a package for retaining a first product and a separate ingredient. The package is formed by a tubular body for retaining the first product. The tubular body is preferably defined by a generally cylindrical sidewall, a hollow interior and first and second open ends. First and second end closures sealingly close the first and second tube ends, respectively. A retainer cup is provided for storing the separate ingredient. The retainer cup includes a generally tubular cup wall having an upper edge portion defining a support rim and a bottom wall closing a bottom end of the cup. The support rim surrounds a cup opening, which provides access to the interior of the cup. One sidewall of the cup wall includes a plurality of longitudinal concave curved groves forming a scalloped surface. The scalloped surface preferably extends along the cup wall, from the bottom wall to the upper edge of the cup and may further define a scalloped profile along the edge of the support rim. A closure lid is provided to engage the support rim on the retainer cup and to overlie the cup opening, closing the separate ingredient within the cup interior. The closure disk is coaxially positioned with the retainer cup within the tubular body. The retainer cup is positioned within the tubular body adjacent the first closure. The closure disk is positioned in contact with the support rim of the retainer cup.

In a further aspect of the package, the cup wall may include a plurality of longitudinally extending the ribs, with one of the ribs positioned between adjacent concave grooves of the scalloped surface. The closure lid may also include a generally planar center portion and a rounded outer periphery. The first portion of the cup wall preferably includes a first outside diameter and the upper edge portion of the cup wall flares outwardly from the first outside diameter, with the outside surface of the support rim positioned radially outward of the outside surface of the first portion. In a further aspect of the package, the scalloped surface is formed on an outside surface of the cup wall, including the upper edge portion.

In a further aspect of the disclosure, a package is defined for retaining an expandable first product and a separate ingredient. The package includes a tubular body for retaining the first product in a first portion thereof. The tubular body includes a generally cylindrical sidewall, a hollow interior and first and second open ends. First and second end closures sealingly close the first and second open ends of the tubular body. A retainer cup is provided for storing the separate ingredient in a second portion of the tubular body, adjacent to the first product. The first and second portions of the tubular body are longitudinally arranged within the hollow interior. The retainer cup includes a generally tubular cup wall, with the cup wall having an upper edge defining a support rim. The support rim surrounds a cup opening, with the opening providing access to the interior of the cup. A bottom wall closes the bottom end of the cup. The cup is preferably positioned within the tubular body adjacent the first closure secured to the first end of the tubular body. One sidewall of the cup wall includes a plurality of concave curved groves forming a longitudinally extending scalloped surface. The scalloped surface of the cup wall may further define a scalloped edge profile for the support rim. A closure lid is configured to engage the support rim on the cup and to overlie the cup opening, closing the separate ingredient within the cup interior. The cup and closure lid are adapted to be stacked within the tubular body, with the closure lid separating the first product from separate ingredient within the cup interior, with the bottom wall contacting the first end closure and with the cup wall extending axially within the tubular body. The pressure from the expandable first product is exerted on the closure lid and is transmitted through engagement of the support rim to the cup wall and in turn to the first end closure. The cup wall remains positioned within the tubular body and is not substantially deformed. The closure lid is retained on the support rim within the package.

In a further aspect of the disclosure, the cup wall may include a plurality of longitudinally extending ribs, with at least one rib positioned between adjacent concave grooves. In a further aspect of the disclosure, the closure lid may include a generally planar center portion and a rounded outer periphery. Further, a first portion of the cup wall preferably has a first outside diameter and the upper edge portion of the cup wall flares outwardly from the first outside diameter. The outward flare of the cup wall positions an outside surface of the support rim radially outward of the outside surface of the first portion. Preferably, the scalloped surface is formed on an outside surface of the cup wall, including the upper edge portion.

Other features of the present invention and combinations of features will become apparent from the detailed description to follow, taken in conjunction with the accompanying drawings.

BRIEF DESCRIPTION OF THE DRAWINGS

For the purpose of illustrating the invention, the drawings show one or more forms that are presently preferred. It should be understood that the disclosure and claimed invention is not limited to the precise arrangements and instrumentalities shown in the drawings.

DETAILED DESCRIPTION

Figure 1:
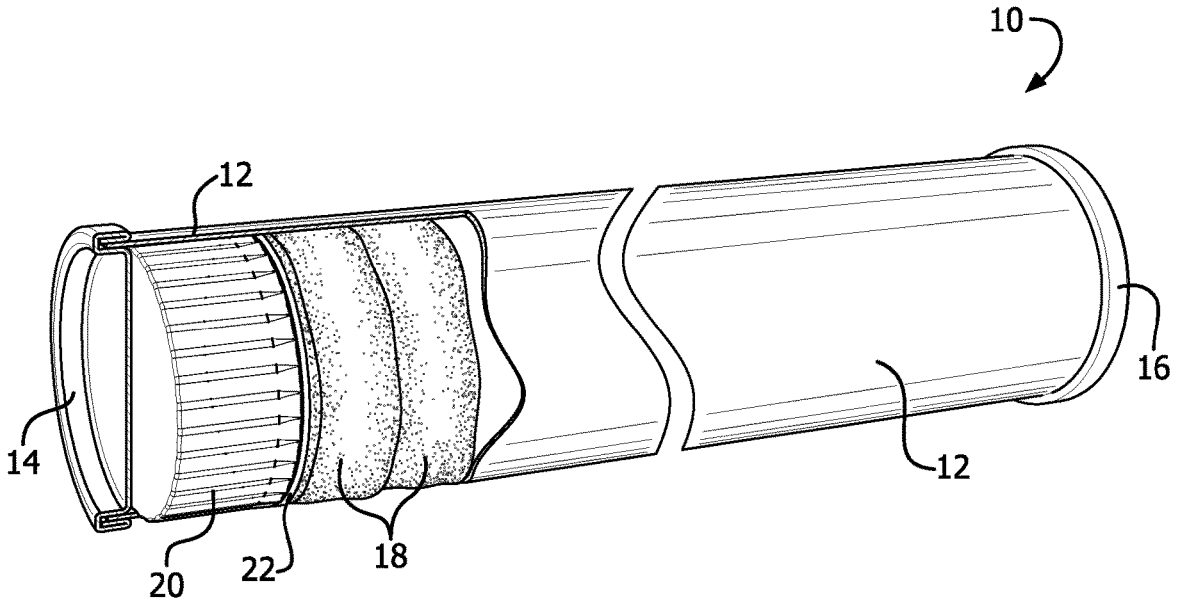
FIG. 1 shows an isometric side view of a package according to the present disclosure, with a portion of the sidewall removed to view elements retained within the package.
Figure 2:
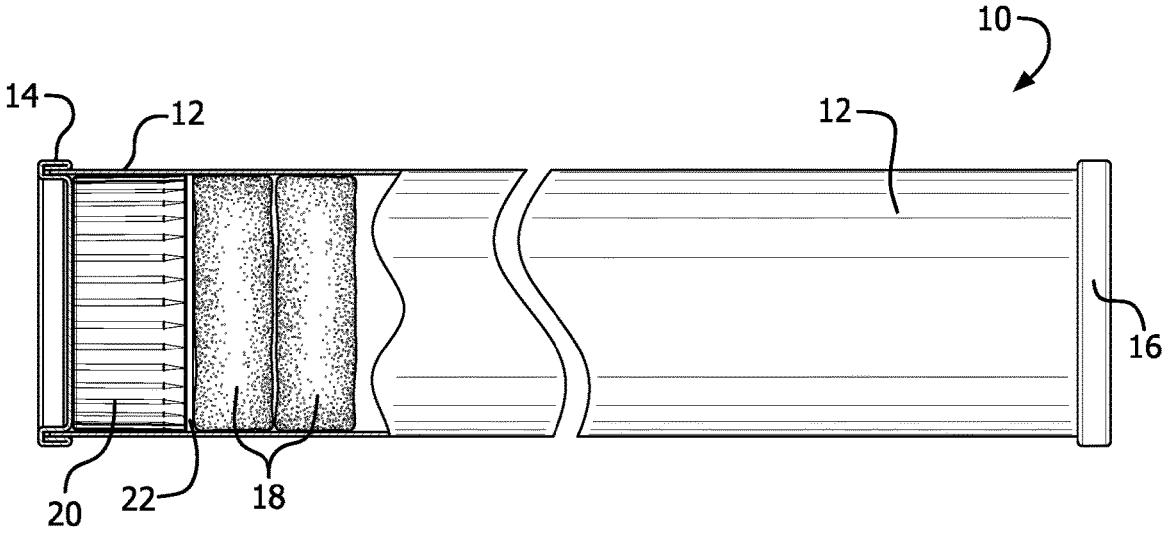
FIG. 2 shows a side elevation of the package, with a portion of the sidewall removed.

In the figures, where like numerals identify like elements, there is shown an embodiment of a package or container identified by the numeral 10. As shown in FIG. 1, the package 10 includes a tubular sidewall 12 and two end caps 14 and 16. A portion of the sidewall 12 is removed for illustration purposes, exposing a plurality of product pieces 18 and a separator cup 20. A cup lid or closure disk 22 is provided on the cup 20 and separates the cup interior from the product pieces 18. As also illustrated in FIG. 2, the end cap 14 is attached to one end of the tubular sidewall 12 by a double seaming method. Other forms of package ends and attachment methods are also possible. The second end cap 16 is contemplated to be similarly attached to the opposite end of the tubular sidewall.

As illustrated, the sidewall has a cylindrical form. Cross sections other than circular are also possible. The package shown is contemplated to be opened by separation of the composite material forming the sidewalls along a spiral seem, as in known in the art. Other opening methods, such as removal of one or both of the end caps, may also be utilized.

Figure 3:
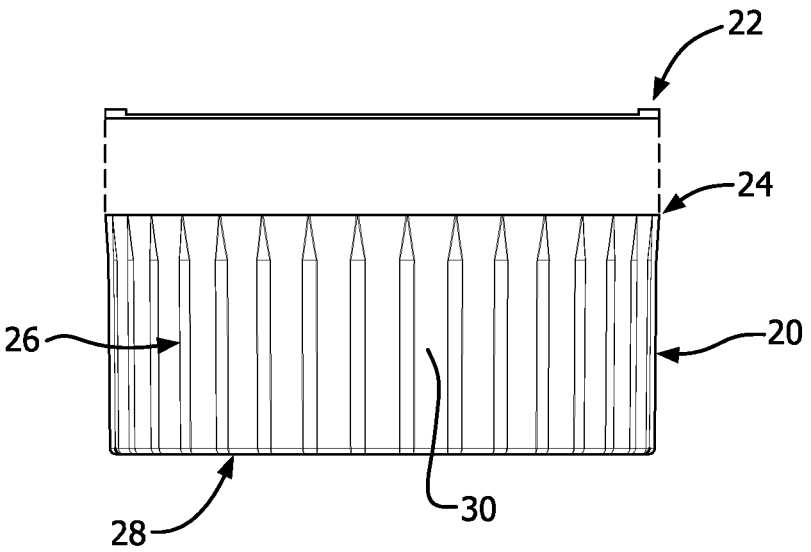
FIG. 3 shows an exploded side elevation of a separator cup and cup lid combination for use with the package shown in FIGS. 1 and 2.

FIG. 3 shows an exploded side view of the separator cup 20 and cup lid 22. The lid 22 is normally placed on the top or support rim 24 of the open end of the cup 20. As more particularly shown in FIGS. 4 and 5, the cup 20 is formed by a generally cylindrical cup wall 26 and a round bottom wall 28. The cup 20 defines an interior volume and an open top end. The interior of the cup 20 is defined to retain a separate ingredient, such as a topping (not shown). The cup wall 26 includes a scalloped outer surface 30. As is more particularly shown in FIGS. 6, 6A and 7, the outer surface 30 of the cup wall 26 also includes a plurality of ribs 32 connected by a concave wall portions 34. The inside surface 36 of the cup wall 26 is shown as smooth, with the scallops formed on the outer surface 30.

Figure 4:
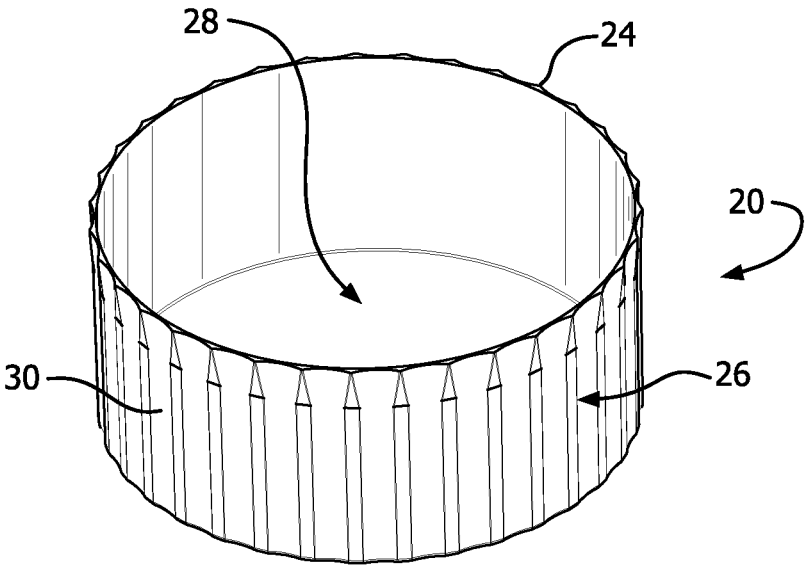
FIG. 4 shows an isometric top view of the separator cup portion of FIG. 3.
Figure 5:
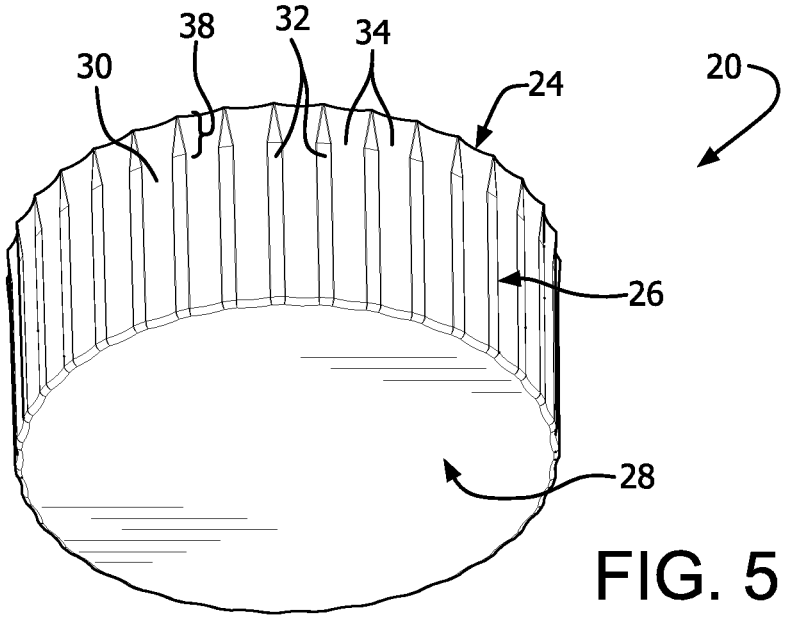
FIG. 5 shows an isometric bottom view of the separator cup of FIG. 3.
Figure 6:
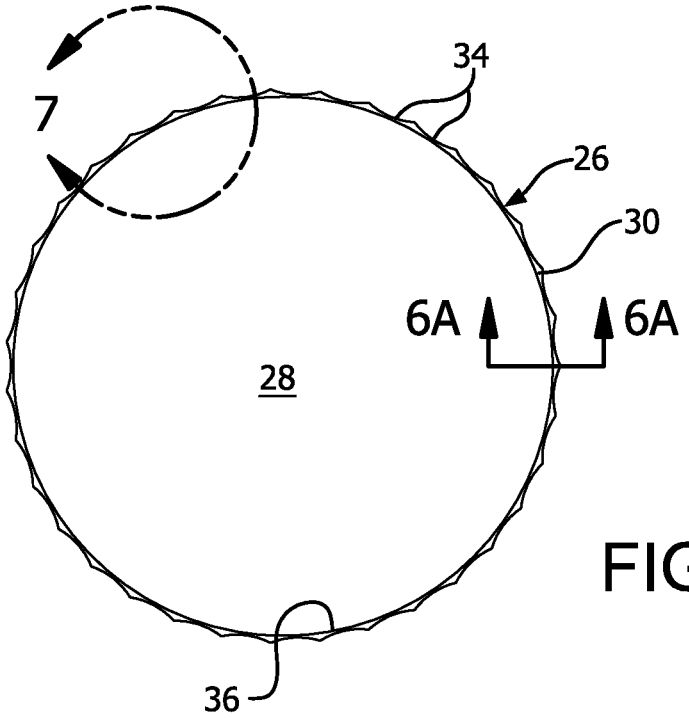
FIG. 6 shows a top plan view of the separator cup of FIG. 3.
Figure 6A:
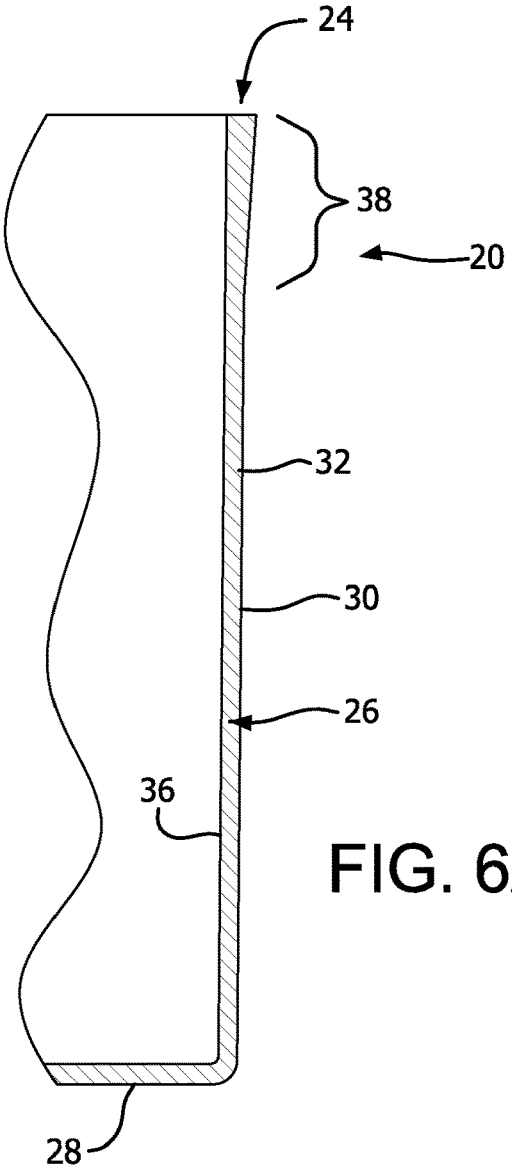
FIG. 6A is a cross section view of the sidewall of the separator cup as taken along line 6A-6A in FIG. 6.
Figure 7:
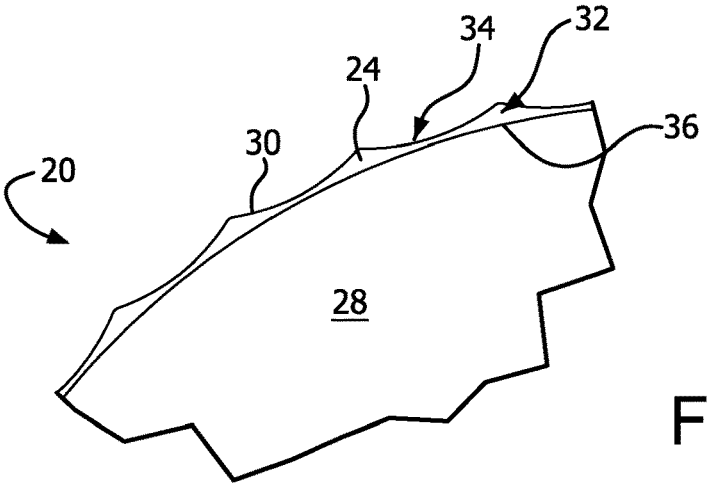
FIG. 7 shows an enlarged portion of the rim of the separator cup, with the portion designated in FIG. 6.

In FIG. 6A, a cross section is taken through the cup wall 26 at the position of a rib 32. The cup wall 26 is integrally formed with the bottom wall 28. The rib portion 32 of the outside surface 30 of the cup wall 26 is shown as having a substantially uniform dimension from the intersection with the bottom wall 28 to a position adjacent the top rim 24. The upper end 38 of the cup wall 26 flairs radially outward at the top edge of the cup 20. As shown in FIGS. 3-5, the ribs 32 are relatively broader (in a circumferential direction) around the body portion of the cup wall 26 and taper to a point on the upper end 38 adjacent the top rim 24. In FIG. 7, the profile of the top rim 24 of the cup 20 is shown. The concave portions 34 of the scalloped outside surface 30 connect the spaced rib portions 32. The rim 24 of the cup wall 26 creates a support surface for the cup lid 22.

Figure 8:
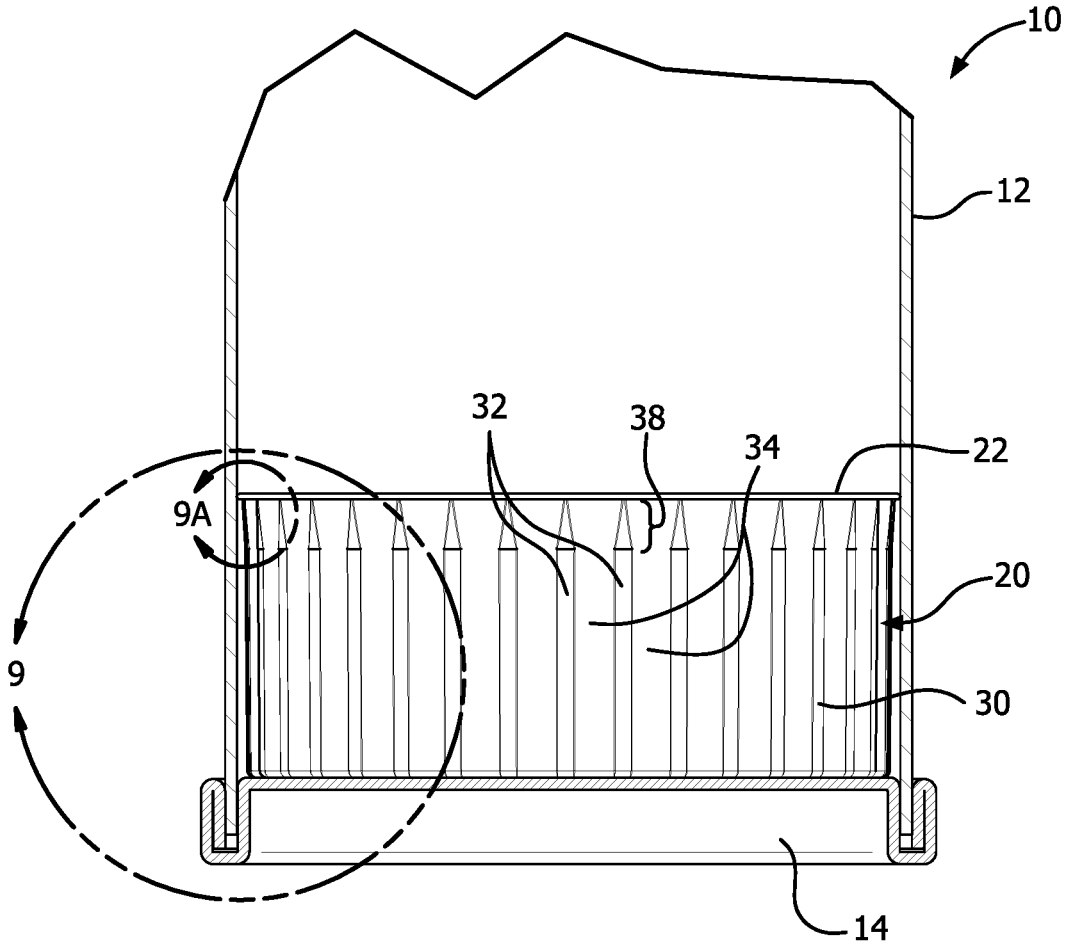
FIG. 8 shows an enlarged portion of one end of the package, with the sidewall and end cap shown in cross section and the separator cup positioned within the package.
Figure 9:
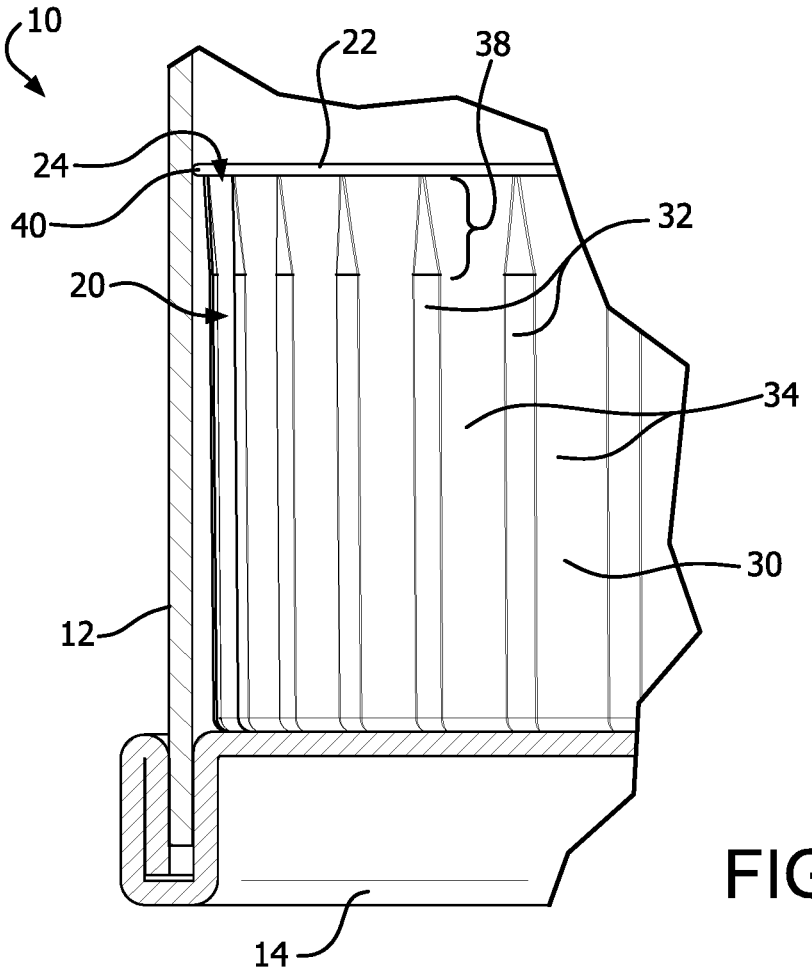
FIG. 9 shows an enlargement of a portion of the package, as designated in FIG. 8.

FIGS. 8 and 9 show the separator cup 20 positioned within the hollow interior of the tubular sidewall 12. The outside surface of the bottom wall 28 of the cup 20 is placed in contact with an inside surface of the end cap 14. The cup lid 22 is positioned on the top rim 24 of the cup 20, closing the interior volume and the separate ingredient (not shown). The product pieces 18 (see FIG. 1) are positioned within the tubular sidewall 12. The second end cap 16 (FIG. 1) is positioned on the second end of the sidewall 12 to close and seal the first product pieces 18 and the separator cup 20 within the package 10.

With reference to FIG. 9, the outer edge 40 of the lid 22 has a dimension less than the inside diameter of the hollow tube of sidewall 12. This dimensional relationship permits the cup lid (and cup) to be positioned within the hollow of the tube. The outward flare of the upper end 38 of the cup wall 26 is also normally spaced from the sidewall 12. The remaining portions of the cup wall 26 are positioned further inwardly from the inside surface of the tube sidewall 12.

Figure 9A:
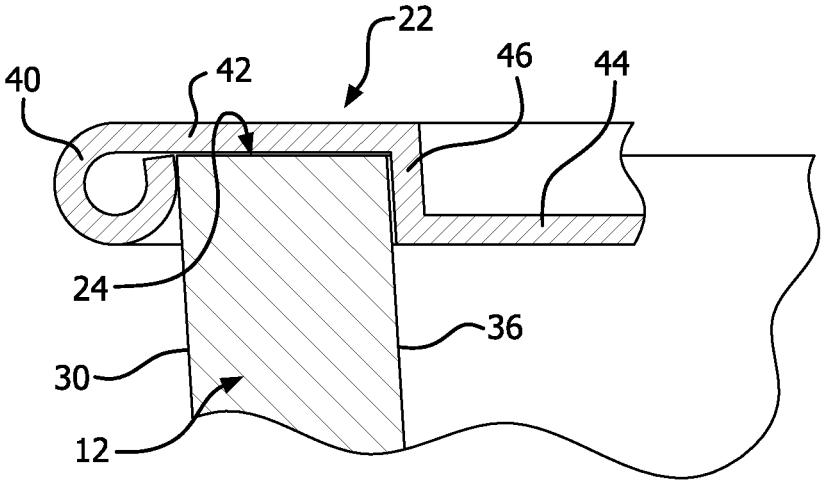
FIG. 9A shows an enlargement of a portion of the package designated in FIG. 8.
Figure 10:
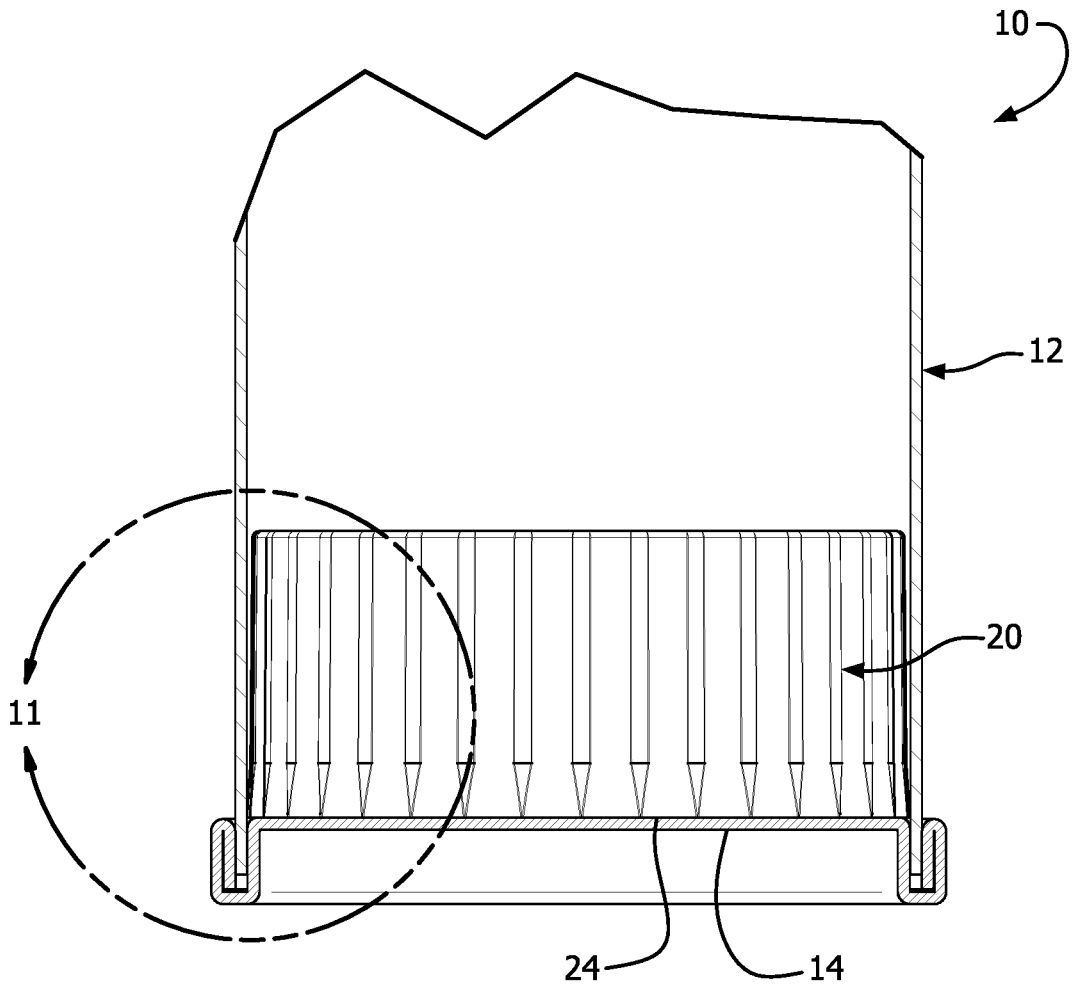
FIG. 10 shows an enlarged portion of one end of a package with the sidewall and end cap shown in cross section and the separator cup shown in an alternate position.

The relationship between the cup lid 22 and the top rim 24 of the cup wall 26 is shown in close-up in FIG. 9A. The cup lid 22 is shown as including a rolled outer edge 40, a support area 42 radially inward of the outer edge 40, a central landing area 44 and a step or shoulder 46 between the landing 44 and the support area 42. The contours of the cup lid may be formed to loosely fit over the top rim 24 of the cup 20, with the shoulder 46 positioned adjacent the inside surface 36 of the cup wall 26 and the outer edge 40 of the lid 22 positioned outside of the cup rim 24. Alternatively, a snap-fit relationship may be created to resiliently fix the cup lid to the top rim of the cup wall. An additional bead or lip structure may be provided on the outside or inside surface of the top rim of the cup wall and a corresponding engagement surface may be provided on the cup lid. A shown, the rolled outer edge 40 or the step surface 46 may provide the necessary interference with the rim of the cup. The cup lid may be molded or otherwise formed with the interfering surface(s). It is contemplated that the force required to secure the lid to the cup and, in turn, to remove the lid will be relative low.

Figure 11:
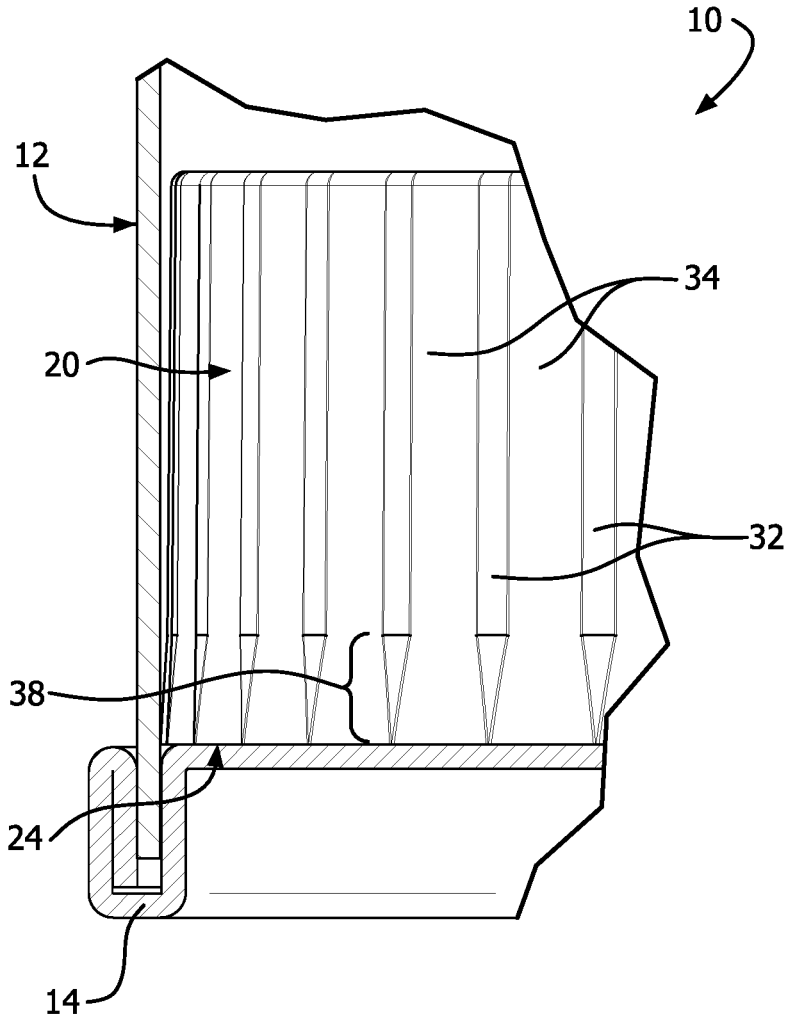
FIG. 11 shows an enlargement of a designated portion of package embodiment shown in FIG. 10.

In FIGS. 11-12, the separator cup 20 is shown within the hollow of the sidewall 12 without a cup lid. The top rim 24 of the cup 20 is positioned in contact with the inside surface of the end cap 14. The end cap 14 closes the interior volume of the cup 20, while the bottom wall 28 of the cup 20 separates the stored ingredient (not shown) from the product (see FIG. 1) also stored within the tube 12.

The separator cup as shown and described is contemplated to be made of plastic and preferably formed by an injection molding process. The tubular sidewall 12 of the package 10 is preferably formed by a paper composite of the type know in the art and is sealed at either end by metal end caps 14, 16. The disc shaped cup lid 22 is preferably formed of metal with a coating thereon to prevent or diminish the likelihood of the product and/or separate ingredient sticking thereto. The product is preferably refrigerated dough with the separate ingredient being a frosting or other topping. The dough is placed in the container with the cup. The end caps are sealed to the ends of the tubular sidewall. Over time, the dough puffs or expands and pressure is built up inside the package. The pressure created by the dough exerts a force on the composite wall of the package, the end caps, and the separator cup.

The separator cup must be strong enough to withstand the pressure of the dough to survive until the consumer opens the package. Compared to a cylindrical cup wall, the present structure is contemplated to provide sufficient rigidity, while also reducing the overall amount of material used to create the separator cup. The scalloped surface effectively removes material as compared to a similarly dimensioned smooth surface. An additional consideration in formation of the cup is contact between the support area of the top rim. Sufficient contact area is necessary to prevent or deter bending or collapse of the cup wall and the top lid under the pressure of the expanding dough.

The flared end of the cup wall assists in deflecting the compressive forces being applied along the wall of the cup. The flaring further serves to increase the rim surface area for contact with the underside of the cup lid (or the end cap). As shown in the cross section of FIG. 6A, preferably, the inside wall maintains the same inside diameter, while the outside wall flairs outwardly. This flaring increased the wall thickness at the top end of the cup wall and the support surface of the top rim. The ribs 32 adjacent the top portion 38 of the cup wall 20 appear to narrow and become thinner. This surface configuration, however, is created by the increase in thickness of the scalloped area between the spaced ribs in the flared region.

The scalloped design around the cylinder of the cup may be created on either the inside or outside surface of the cup wall. The concave curve of the scalloped surface results in a material savings, while providing additional strength to withstand the pressure created by the dough (or the like). For example, the scallop design may result in about a 20% reduction in the overall material weight of the cup. However, a relatively large surface area is provided on the top rim of the cup. As a comparison, if the cylindrical wall thickness of the cup were to be reduced, the effective thickness of the rim would also be reduced and the overall strength of the cup would be diminished.

The present invention has been described and illustrated with respect to one or more exemplary embodiments. It should be understood by those skilled in the art from the foregoing that various other changes, omissions and additions may be made therein, without departing from the spirit and scope of the present invention, with the scope of the invention being described by the foregoing claims.

What is claimed is:

1. A package for retaining a dough product and a separate ingredient, the package comprising:

a tubular body for retaining a dough product, the tubular body having a generally cylindrical sidewall, a hollow interior and first and second open ends;

first and second end closures respectively secured to the first and second open ends of the tubular body;

a retainer cup for storing the separate ingredient, the retainer cup having a bottom wall, a generally tubular cup wall extending from the bottom wall, and an upper support rim at a top end of the cup wall, the cup wall having an upper edge portion defined by the support rim, the support rim surrounding a cup opening, the cup opening providing access to a cup interior and the separate ingredient, and the bottom wall closing a bottom end of the cup wall;

an outside sidewall of the cup wall having a plurality of concave curved grooves forming a scalloped surface, the grooves projecting inwardly into the cup wall and reducing the effective thickness of the cup wall, the scalloped surface extending along the cup wall from the bottom wall to the upper edge; and a closure lid engaging the upper edge of the support rim on the retainer cup, and overlying the cup opening, the closure lid closing the separate ingredient within the cup interior, the closure lid coaxially positioned with the retainer cup within the tubular body adjacent the first open end, and the scalloped surface of the outside sidewall of the cup wall positioned adjacent an inside surface of the cylindrical sidewall of the tubular body, wherein the concave grooves of the scalloped surface form spacing relative to the inside surface of the tubular body along the cup wall, and wherein the closure lid positioned on the upper edge of the support rim is structurally supported by the cup wall when the retainer cup is positioned within the tubular body and adjacent the first closure.

2. The package of claim 1 wherein the cup wall further comprises a plurality of longitudinally extending ribs, with each of the ribs from the plurality positioned on the outside sidewall between adjacent concave grooves of the scalloped surface.

3. The package of claim 1 wherein the scalloped surface of the cup wall further defines a scalloped profile on the upper edge portion of the support rim.

4. The package of claim 1 wherein the closure lid further comprises a generally planar center portion and a rounded outer periphery.

5. The package of claim 1 wherein the closure lid snap-fits onto the support rim of the cup.

6. The package of claim 1 wherein a first portion of the cup wall has a first outside diameter and an upper portion of the cup wall flares outwardly from the first outside diameter, wherein the upper portion adjacent the upper edge portion is positioned radially outward of the outside diameter of the first portion.

7. The package of claim 1 wherein the scalloped surface is formed on the upper edge portion adjacent the support rim.

8. A package for retaining an expandable first product and a separate ingredient, the package comprising:

an elongated tubular body for retaining an expandable first product in a first portion thereof, the tubular body having a generally cylindrical sidewall, a hollow interior and first and second open ends;

first and second end closures sealingly closing the first and second open ends, respectively, of the tubular body;

a retainer cup for storing a separate ingredient in a second portion of the tubular body adjacent to the expandable first product, the first and second portions of the tubular body being axially arranged within the hollow interior, the retainer cup having a bottom wall and a generally tubular cup wall projecting from the bottom wall, the cup wall having an upper edge defining a support rim, the support rim surrounding a cup opening, the cup opening providing access to a cup interior volume and the separate ingredient retained therein, and the bottom wall closing a bottom end of the cup interior volume, the retainer cup retained within the tubular body adjacent the first closure secured to the first end; and an outside sidewall of the cup wall having a plurality of adjacently positioned longitudinally extending, inwardly directed concave curved grooves forming a scalloped surface within an outside surface of the cup wall, the scalloped surface of the cup wall extending from the bottom wall to the upper edge, the scalloped surface further defining a scalloped edge profile adjacent the support rim; and a closure lid configured to engage the support rim on the retainer cup, to be supported by the cup wall and to overlie the cup opening, the closure lid closing the separate ingredient within the cup interior volume;

the retainer cup and the closure lid stacked within the tubular body, with the closure lid separating the expandable first product from the separate ingredient within the cup interior volume, and the bottom wall contacting the first end closure and the cup wall extending axially within the tubular body, the scalloped surface of the cup wall closely adjacent an interior surface of the cylindrical sidewall of the tubular body and the longitudinal concave grooves of the scalloped surface spaced from the interior surface of the tubular body, wherein pressure from the expandable first product is exerted on the closure lid and is transmitted through engagement of the support rim to the cup wall and in turn to the first end closure, and wherein the cup wall supports the closure lid within the package, and wherein the concave grooves of the scalloped surface remain spaced from the interior of the tubular wall forming a passageway therebetween.

9. The package of claim 8 wherein the cup wall further comprises a plurality of longitudinally extending ribs, with each of the ribs positioned between adjacent concave grooves on the outside surface of the side wall.

10. The package of claim 8, wherein the closure lid further comprises a generally planar center portion and a rounded outer periphery.

11. The package of claim 8 wherein a first portion of the cup wall comprises a first outside diameter and the upper portion of the cup wall flares radially outwardly from the first outside diameter to form a second outside diameter, wherein an outside surface of the upper portion, adjacent the upper edge portion, is positioned radially outward of an outside surface of the first portion of the cup wall.

12. The package of claim 8 wherein the closure lid snap-fits onto the support rim of the cup.

13. A package for retaining an expandable first product and a separate ingredient, the package in combination comprising:

a tubular body for retaining an expandable first product in a first portion thereof, the tubular body having a generally cylindrical sidewall, a hollow interior and first and second open ends;

first and second end closures sealingly closing the first and second open ends, respectively, of the tubular body;

a retainer cup for storing an separate ingredient in a second portion of the tubular body adjacent to the expandable first product, the first and second portions of the tubular body being axially arranged within the hollow interior, the retainer cup having a generally tubular cup wall, the cup wall having an upper edge defining a support rim, the support rim surrounding a cup opening, the cup opening providing access to a cup interior, the separate ingredient retained within the cup interior, and a bottom wall closing a bottom end of the cup interior, the retainer cup retained within the tubular body adjacent the first closure secured to the first end of the tubular body, and a plurality of longitudinal, concave, adjacently positioned and curved grooves within the cup wall, the grooves forming a continuous scalloped surface on the outer cup wall and further defining a scalloped profile for the support rim;

the retainer cup stacked within the tubular body with the expandable first product, the cup rim contacting the first end closure, the first end closure closing the cup opening and the grooves of the scalloped surface of the outer cup wall extending axially within the tubular body, the retainer cup separating the expandable first product from the separate ingredient within the cup interior, whereby pressure from the expandable first product is exerted on the bottom wall and is transmitted through the cup wall to the support rim and the first end closure, such that the scalloped surface of the cup wall structurally supports the retainer cup, and the concave grooves of the scalloped surface remain spaced from the interior of the tubular wall within the package.

14. The package of claim 2 wherein an upper end portion of the plurality of the ribs taper in the area of the upper edge portion of the cup wall.

15. The package of claim 6 further comprising a plurality of longitudinally extending ribs positioned on the outside sidewall between adjacent concave grooves of the scalloped surface, and an upper end portion of the plurality of the ribs taper in the area of the upper portion of the cup wall.

16. The package of claim 9 wherein an upper end portion of the plurality of ribs taper in the area of the upper edge portion of the cup wall.

17. The package of claim 11 further comprising a plurality of longitudinally extending ribs positioned on the outside sidewall between adjacent concave grooves of the scalloped surface, and an upper end portion of the plurality of the ribs taper in the area of the upper portion of the cup wall.

* * * * *